United States Patent [19]

Coleman

[11] Patent Number: 4,826,138

[45] Date of Patent: May 2, 1989

[54] APPARATUS FOR HEAT TREATING STEEL PLATES

[75] Inventor: Vincent R. Coleman, Aurora, Ohio

[73] Assignee: Van Dorn Company, Cleveland, Ohio

[21] Appl. No.: 132,723

[22] Filed: Dec. 11, 1987

Related U.S. Application Data

[60] Continuation of Ser. No. 657,675, Oct. 4, 1984, abandoned, which is a division of Ser. No. 583,343, Feb. 24, 1984, abandoned.

[51] Int. Cl.[4] ..... C21D 9/00

[52] U.S. Cl. ..... 266/115; 266/117; 266/259

[58] Field of Search ..... 266/114, 115, 117, 259, 266/102; 148/153, 155

[56] References Cited

U.S. PATENT DOCUMENTS

| | | | |
|---|---|---|---|
| 2,783,788 | 3/1957 | Ungerer | 266/113 |
| 3,109,044 | 10/1963 | Flowers | 266/113 |
| 3,163,201 | 12/1964 | Schmidt et al. | 72/160 |
| 3,423,254 | 1/1969 | Safford et al. | 266/113 |
| 3,429,164 | 8/1969 | Oganowski et al. | 72/161 |
| 3,604,696 | 9/1971 | Coleman et al. | 266/65 |
| 3,605,471 | 9/1971 | Bodtke | 72/165 |
| 4,132,393 | 2/1979 | Nakamura et al. | 266/117 |

FOREIGN PATENT DOCUMENTS

| | | | |
|---|---|---|---|
| 2537188 | 2/1977 | Fed. Rep. of Germany . | |
| 70258 | 1/1979 | Japan . | |
| 4212 | 1/1979 | Japan | 266/115 |
| 3164934 | 7/1982 | Japan . | |

OTHER PUBLICATIONS

The Fabricator, pp. 18–21, May–Jun. 1986.

*Primary Examiner*—Christopher W. Brody
*Attorney, Agent, or Firm*—Body, Vickers & Daniels

[57] ABSTRACT

A method and apparatus for heat treating steel plates subject to longitudinal length distortion wherein the plate at a temperature of the critical temperature of the steel passes through leveling rolls to remove the length distortion and immediately thereafter through quenching rolls which maintain length uniformity during quenching of the plate.

2 Claims, 4 Drawing Sheets

FIG. 3
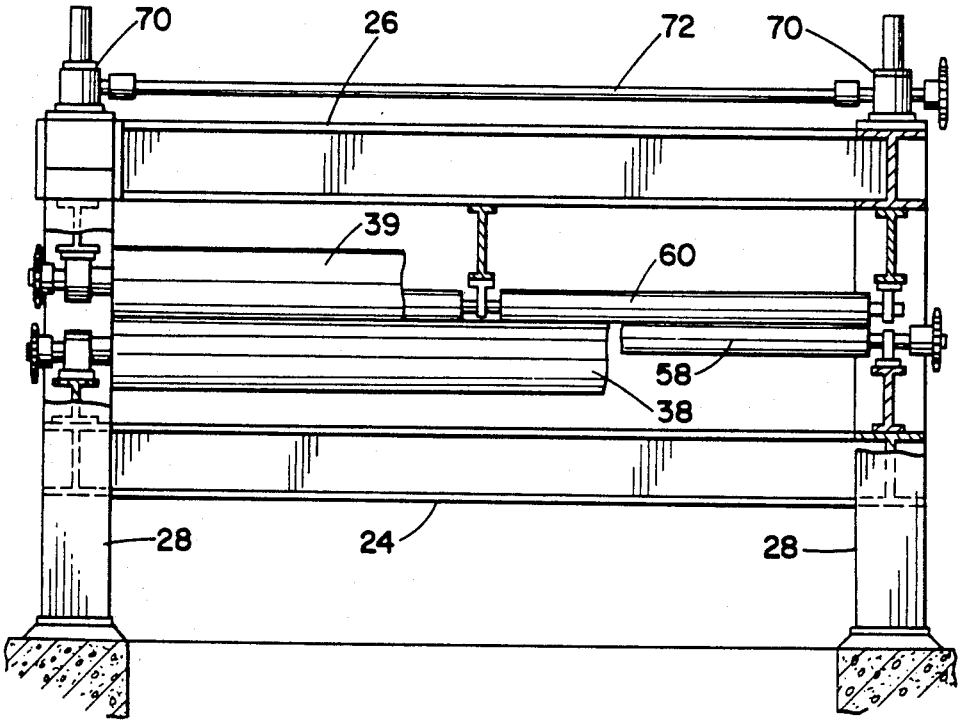
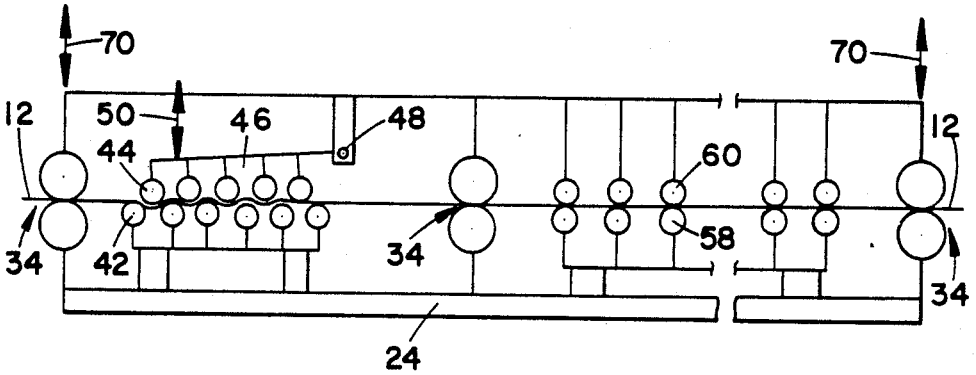
FIG. 5

APPARATUS FOR HEAT TREATING STEEL PLATES

This is a continuation of Ser. No. 657,675, filed Oct. 4, 1984, now abandoned, which is a divisional of Ser. No. 583,343, filed Feb. 24, 1984, now abandoned.

BACKGROUND

The present invention relates to the heat treating of elongated steel members, and, in particular, to a method for continuously leveling and quenching steel plates to provide required flatness without the need of post-quenching leveling and stretching operations.

The invention is particularly directed to the heat treatment of thin steel plates. As is commonly referenced, such plates have a thickness of less than ⅜ inch (0.95 cm.) and a width greater than 48 inches (122 cm.) and the invention will be described with particular reference thereto, although it will be hereinafter appreciated that the invention has applicability for widths and thicknesses therebeyond. The invention will also be described with reference to lower carbon alloy steels wherein the rate of quench is very high and residual longitudinal and lateral distortion preceding or following the quenching and/or tempering operations is particularly troublesome. Flatness has reference to the deviation of the top and bottom surface from a horizontal line when the plate is resting on a flat surface. The limit of the deviation is prescribed for varying thicknesses and width. While industry standards, such as ASTM Standard A-G Tables 16-17 is used to prescribe flatness tolerances, more often the customers or heat treaters will have more stringent requirements. All such standards recognize a greater permissible deviation as the plate gauge is reduced below ⅜ inch Flatness as used herein thus has prime reference to meeting or exceeding the standards applicable to the final product.

These lower carbon alloy steels, heat treated to improve their physical characteristics, are customarily hot rolled at temperatures between 2100° F.-2500° F. (927° C.-980° C.) in accordance with known procedures. The rolled plates, as received from the mill, are reheated to an elevated temperature of 1650° F. (898° C.) or above to assure complete austenitizing of the steel. Thereafter, the plates are subjected to a quenching operation wherein the plate is rapidly cooled from above its austenitizing temperature to below its Ms temperature without transformation. Subsequent thereto, the plates undergo a tempering operation whereby the residual stresses are relieved, and hardness and brittleness characteristics are modified and the ductility improved.

While such heat treating procedures readily provide the required physical properties, the ability to provide the required flatness specifications for certain applications is difficult to attain.

Flatness is a particular problem where the steel plate exiting the rolling operation is subject to longitudinal distortion. Therein, the longitudinal dimensions vary from side to side. Thus, if the edges are shorter than the middle portion, the plate will assume a bowed shape. Where the center dimension is shorter than the edge dimensions, the plate will assume a longitudinal lateral waviness. These physical distortions generally arise from processing conditions in the rolling operation. Furthermore, they may only be manifested after reheating in the austenitizing furnace and to a lesser extent after tempering. In both instances however, the cause for this distortion has been referenced to the rolling inaccuracies, chemical composition variations and temperature variations, all of which are interrelated.

Due to roll crown or center roller deflection under loading, the plate will oftentimes have a greater thickness at the center than at the edges of the plate. Due to differential cooling, this variation can additionally cause temperature variations across the width and attendent chemical composition variations. Each causes incremental stress variations and yield point variations which are physically manifested during the heating and cooling cycles. Where any of these variations cause uncorrected localized yielding, the ultimate product may be longitudinally and laterally distorted beyond acceptable specification.

Attempts have been made to remedy this post-rolling distortion by leveling intermediate the rolling and the heat treating operations. This has not, however, proven to be a particularly successful technique. While producing apparent leveling, the residual stresses cause the distortions to reappear during reheating. Further, the residual internal stresses may be manifested after heat treatment during shipping and other handling or temperature cylces.

Because of the high yield strength of the end product, generally in excess of 100,000 psi, post heat treating processing through leveling and stretching rolls is also of limited benefit in achieving flatness in the hardened plate.

It has been found that an acceptable flatness can be provided by controlling the conditions during the quenching operation. In my prior patent, U.S. Pat. No. 3,604,696, a continuous quenching operation is taught wherein uniformly and rapidly quenching the plate while continuously longitudinally and laterally restraining the plate during the cool down between a series of vertically aligned pressure rolls is effective to provide commercially acceptable flatness. This quench press produces controlled contraction and localized yielding of the plate during quenching thereby eliminating waviness and bowing present in the entering plate. Plates thicker than ⅜ inch, in particular, can be leveled with such an apparatus, with the flatness being retained or improved during the subsequent tempering.

Despite this in-treatment leveling, thinner plates oftentimes can not be effectively leveled. As was previously mentioned, post treatment leveling and stretching meets with limited success because of the high yield strength of the hardened plate. Thus, a plate with unacceptable flatness must be recycled through the heat treatment process, or failing that the plate may be designated for off-specification applications or scrap.

BRIEF SUMMARY OF THE INVENTION

Accordingly, it is an object of the present invention to provide a method and apparatus for heat treating thin steel plates which produce post-treatment flatness and avoid the need for pre-or post-heat treatment leveling and stretching operations or recycling or scrapping of unacceptable plates.

In accordane with the present invention, thin low carbon steel plates, subject to or prone to lateral and longitudinal distortion, are heated to an elevated temperature above the austenitizing temperature of the steel, preferably in excess of 1650° F. After sufficient holding time to assure complete austenitizing, the plates, still above the critical temperatures, are rapidly, continuously, reversely flexed without a significant temperature drop. The leveling induces localized yielding and hot working of the plate such that longitudinal and stress equalization of the plate is achieved across its transverse section. This produces a flatness which is within the further leveling capability of the quench press. Immediately after leveling, the plate passes to a quenching operation which rapidly and uniformly cools the plate to below the Ms temperature while laterally and longitudinally restraning the plate such that the plate is cross-sectionally tensioned during the cooling. The tensioned thermal contraction continues the leveling process, further accomodating localized yielding in high stress area. The entering flatness is maintained or improved and the residual stresses are below the level that would result in further localized yielding as the plate undergoes the subsequent tempering or post treatment handling.

In practicing the aforementioned method, the steel plate, at a temperature above its critical temperature, is longitudinally fed through a series of alternating decreasingly vertically offset rollers at a high rate of speed and without an appreciable temperature drop. The initial vertical offset is sufficient to cause localized yielding of the shorter longitudinal section lengths where the yield strength at this temperature is only 2–3% of that of the finished product. The subsequent offsets are progressively reduced to hot flex the plate for stress equalization. The preliminarily flatened plate is then fed between a series of vertically aligned cylindrical quench rolls. Quenching jets between the rolls uniformly supply coolant at a rate which rapidly and uniformly lowers the temperature of the plate through the martensite range without transformation. Successive pairs of the rollers are effective to locally tension the plate during the quenching. This accommodates further localized thermal contraction and yielding as required while maintaining plate flatness. At the end of the quenching operations, the internal stresses are below a level which will cause yielding of the plate during the temperature excursion of the subsequent tempering operation.

In this manner, the plate exiting the quenching press will have achieved a flatness equal to or greater than the flatness provided in the leveling operation and a flatness which is not negatived during the heating and cooling of tempering.

It will become apparent that the present invention offers a substantial advance in providing heat treatment leveling of steel plates wherein sequential controlled yielding and stress equalization of the plate during the heating and cooling cycles is used to achieve and maintain a flatened condition thereby avoiding the need for subsequent stretching operations and limiting material subject to recycling or scrapping.

BRIEF DESCRIPTION OF THE DRAWING

These and other advantages of the present invention become apparent to one skilled in the art upon consideration of the following specification with reference to the accompanying drawings in which:

FIG. 3 is a partially broken end view taken along line 3—3 in FIG. 1;

FIG. 5 is a schematic elevational view of the heat treating unit illustrating the principles of the present invention; and, FIG. 6 is a schematic elevational view of the drive trains for the leveling and quenching assemblies.

DETAILED DESCRIPTION OF THE INVENTION

Figure 1:
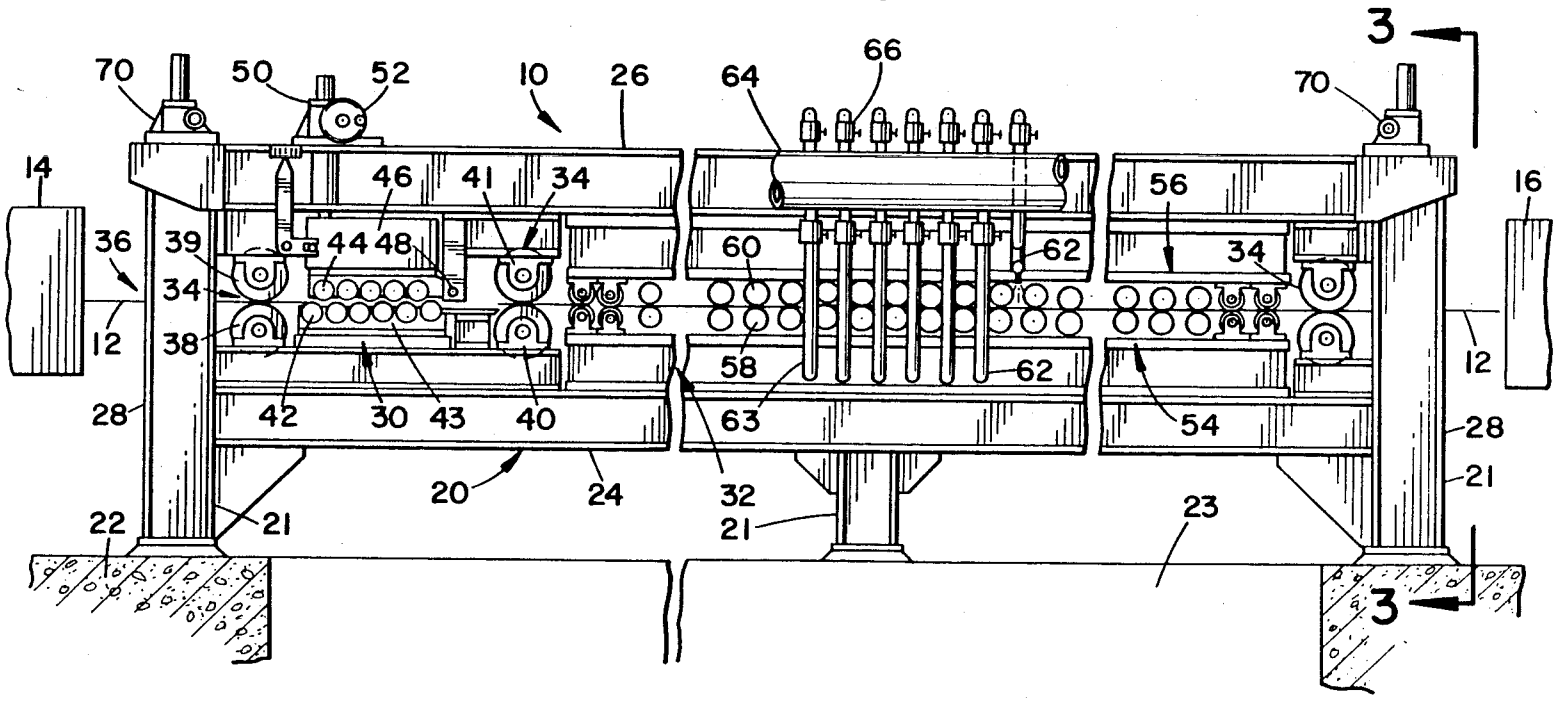
FIG. 1 is a side elevational view of a heat treating unit made in accordance with the present invention.

Referring to the drawings for purposes of illustrating the preferred embodiment of the invention only and not for the purpose of limiting the same, there is shown in FIG. 1 a heat treating unit 10 for continuously leveling and quenching thin low carbon steel plates 12. The plates 12 travel horizontally from an austenitizing furnace 14 through the unit 10 into a tempering furnace 16.

As is conventional in heat treating such steels, the plate 12 is heated in the austenitizing furnace 14 to a temperature above its critical temperature for a sufficient time to assure complete austenitizing of the steel. Generally the furnace temperature is in excess of 1650° F., preferably over 1700° F. The plate 12 is then rapidly and uniformly cooled in a quenching operation through the Ms temperature and through the Mf temperature to transform the austenite to martinsite. The quenched plate is then reheated to an elevated temperature in the tempering furnace 16 for improving the strength characteristic. The temperatures and times are dependent in a conventional manner upon the composition of the alloy and the ultimate properties desired.

The present invention is particularly suited for thin steel plates having a thickness of less than around ⅜ inch and having a width in excess of 14 inches. Such plates, because of the preceding hot rolling, temperature variations and chemical composition variations, are particularly prone to distortion exiting the austenitizing furnace, and to certain extents, subsequent to the tempering operation. However, it will be apparent that the benefits of the invention apply as well for plates of greater thicknesses and lesser widths.

The aforementioned distortions are physically characterized by variations in the longitudinal edge length compared to the length of the center portion. Accordingly, where the length of the longitudinal edge is greater than the longitudinal length of the center section, the edge will assume a wavy appearance. Where the longitudinal edges are shorter than the center section, the plate will assume a bowed or fluted shape. This can cause a horizontal deviation of 12 inches or more. By use of the subject heat treating apparatus, such entering distortions are removed and the tendency to form such distortions in the final product are eliminated.

More particularly, the heat treating unit 10 comprises a frame assembly 20 having downwardly depending legs 21 appropriately connected to a foundation 22 surrounding a quench basin 23. The frame assembly 20 includes a fixed lower framework 24 and an upper framework 26 supported on end sections 28 disposed at either end of the frame assembly 20 and vertically movable with respect to the lower frame member.

Disposed interior of the frameworks 24 and 26 are a leveling assembly 30 adjacent the entry end of the heat treating unit 10 and a quenching assembly 32 adjacent the exit end of the unit 10. The overall size of the unit will be determined by the size capability of the unit for treating an array of plate sizes and thickness. However, a unit for heat treating plates of up to 108 inches wide, in thicknesses to below ¼ inch, to conventional hardnesses would be in the order of 30 feet long by 8 feet high by 10 feet wide.

Three pinch roll assemblies 34 are longitudinally disposed along the frame assembly 20, one being positioned at the entry end in advance of the leveling assembly 30, one positioned intermediate the leveling assembly 30 and quenching assembly 32, and one positioned after the quenching assembly 32. The opposed nips of the upper and lower roller sets of the leveling assembly 30, the quenching assembly 32 and the pinch roll assemblies 34 define a horizontal path 36 through which the plate 11 longitudinally travels during the leveling and quenching operations.

The pinch roller assemblies 34 comprise a lower roll 38 and an upper roll 39 and are operative to longitudinally feed the plate through the unit. The pinch rolls may be solid or hollow cylinders with a diameter of about 10". The lower rolls 38 are fixedly connected to and rotatably supported by bearing chocks 40 on the lower framework 24. The upper rolls 39 are fixedly connected to and rotatably supported by bearing chocks 41 on the upper framework 26. The axes of rotation of the lower roll 38 and the upper roll 39 are transverse to the longitudinal path 36 and lie in a common vertical plane. The nips of the lower rollers 38 lie in a common lower horizontal plane. The nips of the upper rollers 40 lie in a common upper horizontal plane. In operation, the lower rolls compressively and frictionally engage the bottom surface of the plate and the upper rolls compressively and frictionally engage the top surface of the plate during movement along the path 36 through the leveling and quenching operations as loaded by the upper framework 36.

The feed rate and loading are predetermined by the size, thickness, composition and desired properties for the plates being treated.

Figure 2:
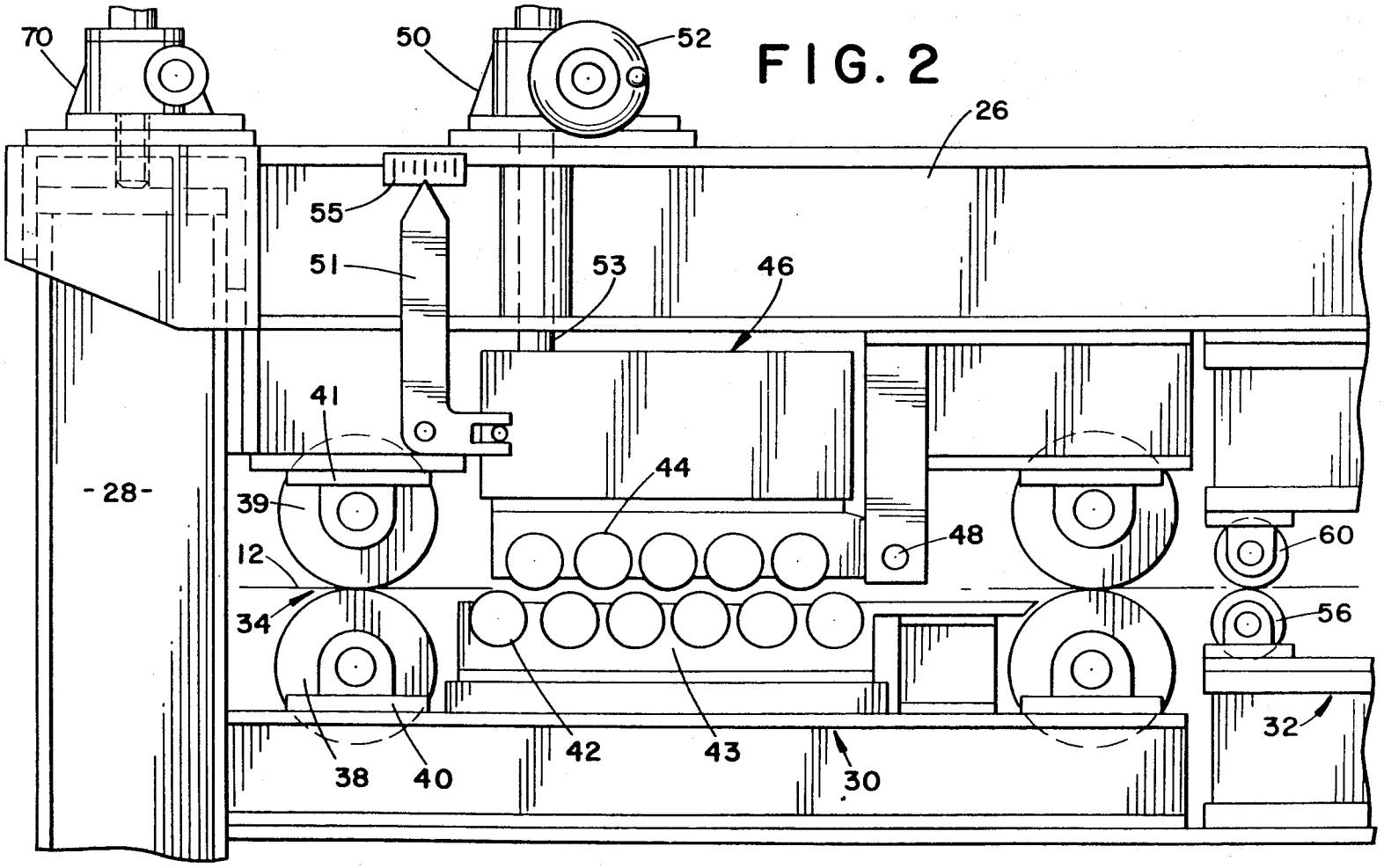
FIG. 2 is an enlarged elevational view showing the leveling assembly of the heat treating unit of FIG. 1.
Figure 4:
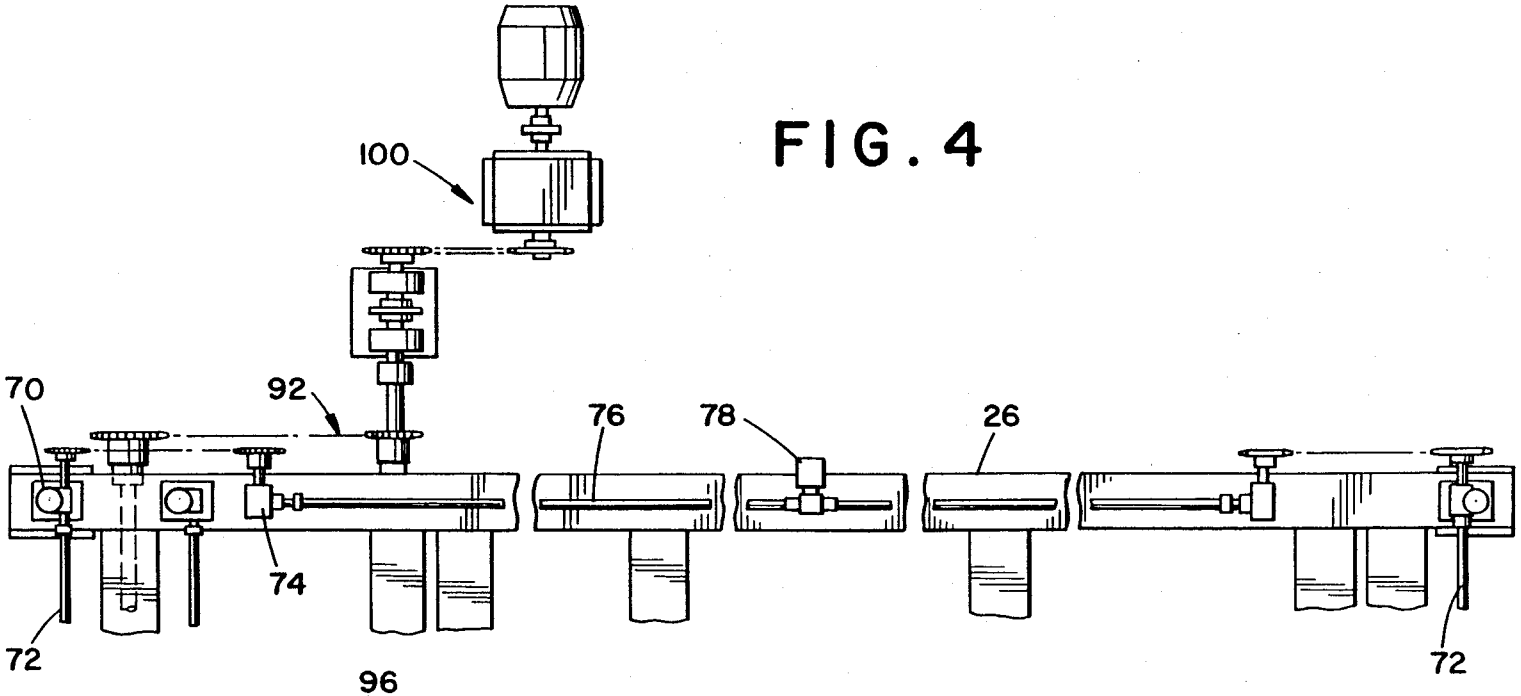
FIG. 4 is a partially broken top view of the heat treating unit shown in FIG. 1.

Referring to FIG. 2, the leveling assembly 30 includes alternating upper and lower rolls. More particularly, six equally longitudinally spaced lower rolls 42 are rotatably supported on a base assembly 43 fixedly connected to the lower framework 24. The lower rolls 42 have axes of rotation transverse to the path 36. The nips of the individual lower rolls 42 lie in a horizontal plane coextensive with the plane defined by the nips of the lower pinch roll 38. The lower rolls 42 have their outer contours locally engaging the bottom surface of the plate 12. Five equally longitudinally spaced upper rolls 44, mounted on a upper base assembly 46 are disposed vertically intermediate the lower rolls 42. The axes of rotation of the upper rolls 44 are transverse to the path 36 and lie in a common pivotally adjustable plane.

Similar to the rolls of the quenching assembly which are shown in FIG. 3, the leveling rolls have a solid cross-section and a roll diameter of about 6 inches. The individual rolls are centrally longitudinally divided into two rolling sections and are rotatably supported at their ends and middle by bearing chocks.

The base assembly 46 is pivotally connected at an inner end to the upper framework 26 by pin connection 48. The outer end of the assembly 46 is operatively connected to a drive unit 50 mounted on the upper framework 26. The drive unit 50 is manually adjustable by drive wheel 52 to raise or lower shaft 53 to pivot the rolls 44 about the pin connection 48 thereby progressively raising or lowering the upper rolls 44 between the lower rolls 42. The movement of the upper rolls 44 is visually determined by a pivoting indicator arm 51 and scale 55. Accordingly, an entering plate passing between the leveling rolls will be alternatingly downwardly and upwardly flexed by the leveling assembly with progressively lesser flexing toward the inner end of the assembly. Should uniform progressive flexing of the plate be desired, the rolls 44 can be vertically adjustable as a unit with respect to the upper framework and lower rolls. However, the progressive roller arrangement is effective in initially removing the longitudinal distortion with the subsequent leveling being of a less severe nature to progressively flex and hot work the plate to equalize the internal stresses.

The leveling assembly has been described with eleven rolls. However, it will be appreciated that any number greater than three can be utilized depending on the required processing capabilities of the unit.

The quenching assembly comprises lower and upper roll assemblies 54 and 56 respectively. The lower roller assembly 54 is fixedly connected to the lower framework 24. The upper assembly 56 is fixedly connected to the upper framework 26. The assemblies 54 and 56 carry a plurality of vertically opposed, equally longitudinally spaced lower rolls 58 and upper rolls 60. The lower rollers 58 have axes of rotation transverse to the path 36 with the nips thereof lying in a horizontal plane coextensive with the nips of the lower pinch rolls 38. The axes of rotation of the upper rolls 60 lie in a common vertical plane with the opposed rolls 58 transverse to the path 36 in a horizontal plane coextensive with the nips of the upper pinch rolls.

Referring to FIG. 3, the individual rolls are six inches in diameter and are longitudinally divided in two roller sections. The rolls are rotatably supported by bearing chocks at their ends and middle sections to limit center deflection under rolling conditions. It will be appreciated however, that a continuous contour could be provided by the use of backup rollers. The rolls and back up rollers may be provided with internal cooling for enhancing the uniformity of cooling during quenching.

In operation, the lower rolls 58 compressively and frictionally engage the bottom surface of a plate. The upper rolls 60 compressively and frictionally engage the top surface of the plate. Either or both of the roll assemblies may be spring biased toward the other so as to establish varying levels of compressive engagement with the plate.

Quenching jets 62 are disposed on either side of the plate and longitudinally between successive rolls throughout the quenching assembly. The jets 62 are respectively fluidly connected by pipes 63 to a main supply conduit 64 extending along the length of the upper frame 26. The flow rates of the individual jets 62 are controlled by valves 66. As previously mentioned, the individual rolls are preferably internally cooled as well. The general fluid interconnections are operative to provide uniform but varying rates of cooling of the plate in a number of longitudinal zones as it traverses the quenching assembly, in a manner consistent with the method and apparatus set forth in the aforementioned U.S. Pat. No. 3,604,696.

The drive means for raising and lowering the upper framework 26 with respect to the lower framework 24, includes right angle drive units 70 disposed in pairs on the opposed end sections of the framework 26. The units 70 are operatively interconnected by drive shafts 72. The units 70 carry input sprockets which are connected by a continuous roller chain to sprockets mounted on drives 74. The input of the drives 74 are interconnected by drive shafts 76 to a centrally located dual output drive unit 78. The input of the unit 78 is operatively connected to a motor and speed reducer assembly, not shown. Accordingly, upon energization of the motor and speed reducer assembly, the drive means are effective to simultaneously drive the units 70 to guide the framework vertically and uniformly along threaded posts 84 supported on the top of the end sections 28. The overall weight of the upper framework establishes the loading between the pinch rollers, the leveling rolls and the quench rolls with respect to the plate 12. The drive means are vertically adjusted for accomodating plates of varying thicknesses.

Figure 6:
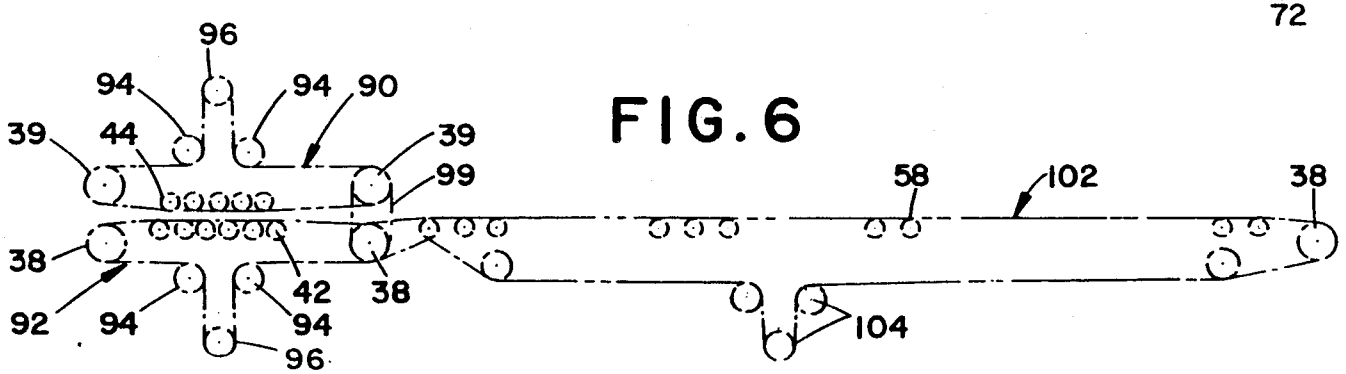

Referring to FIG. 6, the drive trains for roll to roll driving are schematically shown. More particularly, the first two upper pinch rolls 39 and the upper leveling rolls 44 are drivingly interconnected as a set by a roller chain and sprocket drive 90. Sprockets are mounted on the outer ends of individual rolls at both sides of the upper frame members. The first two lower pinch rolls 38 and the lower rolls 42 of the leveling assembly 30 are similarly interconnected by a second chain and sprocket drive 92. The sprockets are mounted on the other ends of the associated roller on both sides of the upper frame. Each drive 90 and 92 includes idler and adjustment sprockets 94 and 96 respectively. Secondary sprockets of the inner pinch rolls are interconnected by a roller chain 99. One of these sprockets is drivingly connected to an electric motor and speed reducer assembly 100. Accordingly, all of the interconnected rollers are driven at the same peripheral speed for advancing the plate through the leveling unit. Because of the common peripheral speed through the leveling unit, the plate is not fed under tension. However, if desired, tensioning may be provided through sprocket changes or the like.

The lower rolls of the quenching assembly and the remote pinch roll assembly 34 are drivingly interconnected by a chain and sprocket drive 102. The upper rolls are idler rolls The sprockets are mounted on the outer ends of the rolls at the sides of the lower framework 24. The drive 102 includes idler and adjustment sprockets 104.

The sprockets of the intermediate pinch roll is interconnected to the sprocket of the inner quench roll by drive chain 106. The drives are effective to rotate the lower quench rollers, the leveling rolls and the pinch rolls at the same peripheral speed. If desired, the peripheral speed in the quenching assembly may vary with respect to that of the leveling assembly by providing independent drives so as to directly tension the plate during the contraction of the plate in the quenching operation. It should be further apparent that the intermediate pinch roll assembly may also constitute a driven element in the quench drive transmission with the relative speed being adjusted to provide the same overall effect.

OPERATION OF THE PREFERRED EMBODIMENT

Steel plates as received from the rolling mill are reheated inthe austenitizing furnace 14 to an elevated temperature in excess of the critical temperature of the alloy. The actual temperature is such that all carbides are in solution to take full advantage of the hardenability of the particular steel involved. In general, this temperature will be 1650° or higher, preferably around 1700° F. As delivered, the steel plates may have initial longitudinal distortion, or as commonly is the case upon reheating in the austenitizing furance 14, residual stresses due to variations in the rolling procedure and chemical compositions may cause the generally flat as-received plate to assume such distorted condition. Further, such plate may be prone post-heat treatment distortion following the tempering or subsequent handling.

To ready the apparatus 10 for the heat treatment of a particular width and thickness of plate, the upper framework 26 is adjusted by the quench press lift drive to receive the plate with the upper framework exerting a compressive loading at the nips of the pinch roller assemblies and the rollers of the quenching assembly 32. This loading will be sufficient to maintain the desired loading and feeding as a plate travels through the assembly while locally and laterally restraining the moving plate. Depending on the anticipated or historical distortion of the plates, the leveling assembly 30 is adjusted by means of drive 50 to pivot the upper leveling rolls 44 with respect to the lower rolls 42 to provide the necessary vertical offsets and flexing to remove the longitudinal distortions and equalize the stresses.

The feed rate provided by the pinch rolls is at a predetermined rate dependent upon the temperature, the alloy, its thickness and other factors.

Referring to FIG. 5, the plate passes through the leveling assembly and is alternately downwardly and upwardly flexed along the contours of the leveling rolls exiting the final lower roll in a substantially leveled condition before entering the intermediate pinch rollers. This pass lengthens the shorter longitudinal sections of the plate, which have contributed the waviness or fluting, beyond their elastic limit thereby locally lengthening and eualizing the incremental lengths. Inasmuch as the pinch rolls of the first two sets are driven at a common peripheral speed, the sheet is not subjected to any tensile loading within the leveler, the localized leveling through yielding merely establishing length uniformity and stress equalizations through the reverse flexing operation. Should it be desired to establish tensile loading on the sheet during the leveling operation, the same may be effected through conventional means. For instance, a change in sprocket gearing or coupling the intermediate roller to the drive chain of the quench assembly could be used to achieve a differential speed with respect to the peripheral drive speed in the leveler rolls.

It is preferred to locate the unit as closely as possible to the austenitizing furnace so as to minimize any cool down of the plate prior to the quenching operation. This is particularly important for the thin plates of the present invention. This is further minimized by driving the plate through the unit at a high rate of speed in the order of 20 to 200 feet per minute such that they pass through the leveling operation without any substantial reduction in the temperature and arrive at the quenching operation at the aforementioned figure of around 1650° F. or above. The leveled plates then pass through the longitudinal series of quenching rollers under lateral and longitudinal tensioning and outwardly of the unit from the final pinch rollres into the tempering furnace 16.

During the quenching operation, the flow rates through the quench jets are adjusted to provide varying quenching zones such that the plates pass from the austenitizing temperature through the martinsite transformation temperature range at a rate rapid enough to prevent any transformation and to provide substantial uniformity and hardening throughout the plate. Depending on the thickness of the plate and the alloy composition, the feed rate and quenching adjustments are appropriately controlled.

The lateral and longitudinal constraints provided by the quenching rollers, tensions the plate during thermal contraction.

This lateral and longitudinal incremental and overall tensioning thus maintains the entering flatness from the leveling assembly and the thermal contraction is effective to cause any remaining or newly developed localized deviations to assume planarity during quenching. This also is effective to accommodate localized yielding, to the extent the yield strength is exceeded at the prevailing temperature, and further stress equalization. The residual stresses in the plate upon relaxation following the quenching operation will be below the yield point of the material during the thermal cycle of the tempering operations. As such, the plate retains its flatness throughout the tempering cycle. Further downstream operations for leveling and stretching are not required for the finished sheet. This is particularly advantageous inasmuch as the yield strength of the hardened and tempered steel is around 80,000–100,000 psi or above where it has been found to be virtually impossible to remove residual distortions. Further, the hardened plate undergoing such operations is subject to unacceptable surface cracking. The flatness achieved in the subjet apparatus also substantially reduces and eliminates the need for recycling plates through the heattreated cycle which do not meet flatness specifications or those the designated for off-specification application or scrap if recycling does not produce the desired flatness.

The invention has been above described with reference to the preferred embodiment. Obviously, modifications and alternations will occur to those skilled in the art upon reading of this detailed description. It is my intention to include all such modifications and alterations insofar as they come within the scope of the appended claims or equivalence thereof.

I claim:

1. Apparatus for heat treating thin steel plate of about ⅜ inch in thickness with a minimal amount of waviness after said steel has been heated above its critical temperature comprising:

(a) drive roller means for driving said plate through said apparatus along a path co-planar with the longitudinal axis of said plate;

(b) means for longitudinally levelling said plate and reducing internal stresses within said plate by reversibly bending said plate in progressively smaller increments from an entrance end to an exit end of said levelling means, said levelling means including a plurality of first leveller rollers positioned on one side of said plate with centers spaced along an axis generally parallel to said path, a plurality of second leveller rollers positioned on the opposite side of said plate generally nested with respect to said first plurality and having centers spaced generally along an axis inclined relative to said longitudinal path such that the rollers in the second plurality positioned at said entrance end of said levelling means are spaced vertically closest to said first leveller rollers while the leveller rollers in the second plurality at said exit end are spaced vertically furthest from said first leveller roller, all of said leveller rollers extending transversely to said longitudinal plate axis a distance substantially equal to the width of said plate and rotatable about an axis transverse to said longitudinal axis, means for adjusting the inclined axis and simultaneously therewith the position of all of said second leveller rollers to level said plate; and (c) quench means located adjacent said exit end of said leveller means for press quenching said plate to restrain lateral and longitudinal contraction of said plate, said quench means having an entrance end and an exit end and including first and second pluralities of quench rolls positioned above and below said plate respectively with their centers on axes parallel to said longitudinal axis and extending transversely a distance substantially equal to the width of said plate and quench nozzle means interspersed between said rolls for directing liquid quenchant substantially normal to said plate in a progressively controlled and uniform manner as said plate travels from said quench entrance end to said quench exit end whereby said plate is quenched with a minimal amount of flatness distortion.

2. Apparatus of claim 1 wherein said drive roller means further includes only a first pair of pinch rolls positioned adjacent said entrance end of levelling means, a second pair of pinch rolls positioned between said exit end of said levelling means and said entrance end of said quench means, a third pair of pinch rolls adjacent said exit end of said quench means, the diameter of said pinch rolls being greater than the diameter of said leveller rolls and said quench rolls, first drive means for driving said leveller rolls and said pinch rolls in said first and second pairs on one side of said steel plate at a set speed; second drive means for driving said leveller rolls and said pinch rolls in said first and second pairs on the opposite of said steel plate at a set speed; timing means between said rolls of said second pair of pinch rolls to assure that said first and second drive means are at the same speed whereby said plate passes through said levelling means without substantial tensioning thereof; third drive means driving said quench rolls and one of said pinch rolls in said third pair on one side of said plate at the same speed, coordinating drive means between said one of said pinch rolls on one side of said plate with the quench roll adjacent the entrance end of said quench means on the same side of said plate for driving said quench rolls at the same peripheral speed as said levelling and pinch rolls whereby said plate is tensioned as it is quenched in said quench means.

* * * * *